US011655725B2

(12) United States Patent
Poissant et al.

(10) Patent No.: US 11,655,725 B2
(45) Date of Patent: May 23, 2023

(54) ACTIVE CLEARANCE CONTROL SYSTEM AND METHOD FOR AN AIRCRAFT ENGINE

(71) Applicant: PRATT & WHITNEY CANADA CORP., Longueuil (CA)

(72) Inventors: Jeffrey Poissant, Brossard (CA); Cristina Crainic, Longueuil (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 17/376,639

(22) Filed: Jul. 15, 2021

(65) Prior Publication Data

US 2023/0014309 A1 Jan. 19, 2023

(51) Int. Cl.
*F01D 11/24* (2006.01)
*F01D 25/12* (2006.01)

(52) U.S. Cl.
CPC ..... *F01D 11/24* (2013.01); *F01D 25/12* (2013.01); *F05D 2220/323* (2013.01); *F05D 2270/301* (2013.01); *F05D 2270/303* (2013.01); *F05D 2270/312* (2013.01); *F05D 2270/313* (2013.01); *F05D 2270/44* (2013.01)

(58) Field of Classification Search
CPC .... F01D 11/24; F01D 25/12; F05D 2220/323; F05D 2270/301; F05D 2270/303; F05D 2270/312; F05D 2270/313; F05D 2270/44
See application file for complete search history.

(56) References Cited

U.S. PATENT DOCUMENTS

| | | | | |
|---|---|---|---|---|
| 4,999,991 | A | 3/1991 | Haddad et al. | |
| 7,465,145 | B2 * | 12/2008 | Kane | F01D 11/24 415/173.1 |
| 9,657,587 | B2 * | 5/2017 | Bacic | F01D 5/02 |
| 10,414,507 | B2 * | 9/2019 | Schelfaut | F01D 11/24 |
| 10,934,972 | B2 | 3/2021 | Hrach et al. | |
| 11,060,412 | B2 | 7/2021 | Gamm et al. | |
| 2009/0037035 | A1 * | 2/2009 | Hershey | F02C 9/00 706/46 |
| 2017/0130602 | A1 * | 5/2017 | Schelfaut | F01D 11/24 |
| 2020/0291807 | A1 * | 9/2020 | Boudsocq | F01D 25/12 |

FOREIGN PATENT DOCUMENTS

| | | |
|---|---|---|
| EP | 1795861 | 6/2007 |
| EP | 2620601 | 7/2013 |
| EP | 3091194 | 11/2016 |

* cited by examiner

*Primary Examiner* — Courtney D Heinle
*Assistant Examiner* — Ryan C Clark
(74) *Attorney, Agent, or Firm* — Norton Rose Fulbright Canada LLP

(57) ABSTRACT

There is provided a system and a method for controlling a tip clearance between a turbine casing and turbine blade tips of an aircraft engine. At least one operational parameter of the aircraft engine is obtained. Based on the at least one operational parameter, a current value of the tip clearance and a target value of the tip clearance are determined. A limiting factor to be applied to the target value of the tip clearance is computed. The limiting factor is applied to the target value of the tip clearance to obtain a tip clearance demand for the aircraft engine. A tip clearance control apparatus of the aircraft engine is controlled based on a difference between the current value of the tip clearance and the tip clearance demand.

18 Claims, 5 Drawing Sheets

ACTIVE CLEARANCE CONTROL SYSTEM AND METHOD FOR AN AIRCRAFT ENGINE

TECHNICAL FIELD

The application relates generally to engines and, more particularly, to active clearance control for aircraft engines.

BACKGROUND OF THE ART

Active clearance control (ACC) systems are used to control tip clearances in aircraft engines. In most existing ACC systems, a flow cooling air is directed towards a turbine case so that an appropriate tip clearance between the turbine blades and the turbine case is obtained according to engine requirements. It however remains desirable to design such ACC systems such that an increase in engine performance and efficiency can be achieved. Therefore, improvements are needed.

SUMMARY

In one aspect, there is provided a method for controlling a tip clearance between a turbine casing and turbine blade tips of an aircraft engine. The method comprises obtaining at least one operational parameter of the aircraft engine, determining, based on the at least one operational parameter, a current value of the tip clearance and a target value of the tip clearance, computing a limiting factor to be applied to the target value of the tip clearance, applying the limiting factor to the target value of the tip clearance to obtain a tip clearance demand for the aircraft engine, and controlling a tip clearance control apparatus of the aircraft engine based on a difference between the current value of the tip clearance and the tip clearance demand.

In another aspect, there is provided a system for controlling a tip clearance between a turbine casing and turbine blade tips of an aircraft engine. The system comprises a processing unit and a non-transitory computer readable medium having stored thereon program code executable by the processing unit for obtaining at least one operational parameter of the aircraft engine, determining, based on the at least one operational parameter, a current value of the tip clearance and a target value of the tip clearance, computing a limiting factor to be applied to the target value of the tip clearance, applying the limiting factor to the target value of the tip clearance to obtain a tip clearance demand for the aircraft engine, and controlling a tip clearance control apparatus of the aircraft engine based on a difference between the current value of the tip clearance and the tip clearance demand.

DESCRIPTION OF THE DRAWINGS

Reference is now made to the accompanying figures in which.

It will be noted that throughout the appended drawings, like features are identified by like reference numerals.

DETAILED DESCRIPTION

Figure 1:
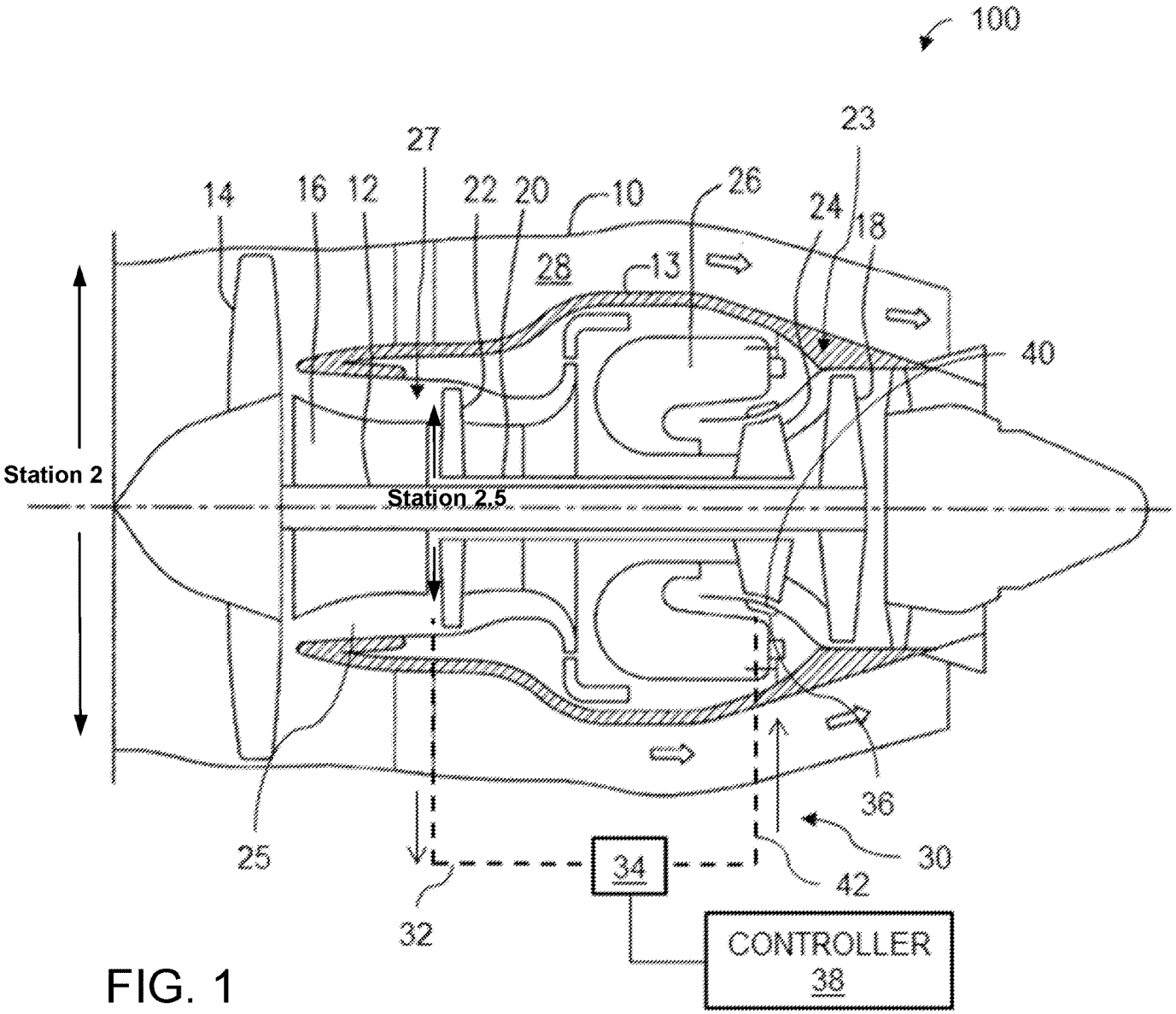
FIG. 1 is a schematic cross sectional view of a gas turbine engine, in accordance with an illustrative embodiment.

FIG. 1 schematically illustrates a turbofan gas turbine engine 100 presented as a non-limiting example and incorporating an active clearance control (ACC) system as described herein. It is understood that aspects described herein may be suitable for use in other types of gas turbine engines. Engine 100 may be of a type suitable for aircraft (e.g., subsonic flight) applications. Engine 100 may comprise a housing or annular outer case 10, annular core case 13, low-pressure spool 12 which can include fan 14, low-pressure compressor (LPC) 16 and low-pressure turbine (LPT) 18, and high-pressure spool 20 which can include high-pressure compressor (HPC) 22 and high-pressure turbine (HPT) 24. Low-pressure turbine 18 and high-pressure turbine 24 may be part of a multistage turbine section 23 of gas turbine engine 100. Similarly, low-pressure compressor 16 and high-pressure compressor 22 may be part of a multistage compressor section 27 of gas turbine engine 100. Annular core case 13 may surround low-pressure spool 12 and high-pressure spool 20, and may define core gas path 25 extending therethrough. Combustor 26 may be provided in core gas path 25. Annular bypass air duct 28 may be defined radially between annular outer case 10 and annular core case 13 for directing a bypass air flow driven by fan 14, to pass therethrough and to be discharged to the ambient environment at an aft portion of engine 100 to produce thrust.

Gas turbine engine 100 may comprise an ACC system 30. In one embodiment, the ACC system 30 is configured to control a clearance or gap (also referred to herein as "tip clearance") between the tips of rotating blades (not shown) of the high-pressure turbine 24 and an inner diameter of turbine case 40. During engine operation, thermal and mechanical radial deflections of the engine's components cause the tip clearance to deviate from the assembly clearance built into the engine 100. The ACC system 30 is used to maintain minimal clearance while avoiding running the turbine blades into the turbine case 40 (a condition referred to as "rubbing" or "rubs") over the entire flight cycle. In one embodiment, the ACC system 30 controls the tip clearance thermally by distributing relatively cool clearance control fluid to the radially outer surface (not shown) of turbine case 40. The clearance control fluid, which may come from engine bleed sources (e.g. bleed air extracted from a compressor section of the engine 100), causes the turbine case 40 to displace radially inwards towards the blade tips of the high-pressure turbine 24 (i.e. to shrink or contract). The tip clearance between the inner diameter of the turbine case 40 and the turbine blade tips is thus lowered. This in turn reduces the amount of combustion gases that escape around the blade tips, thereby increasing efficiency and fuel economy of the engine 100. By controlling the amount of clearance control fluid that is distributed to the turbine case 40 (i.e. by supplying more or less clearance control fluid thereto), the ACC system 30 can lower (i.e. close) or increase (i.e. open) the tip clearance as desired, depending on flight conditions.

In one embodiment, the ACC system 30 may be deactivated when a controller 38 of engine 100 senses that the engine 100 is undergoing sudden transient operation (e.g., fast deceleration or acceleration). In this manner, the high-pressure turbine 24 may be protected from rubs. As such, the ACC system 30 may be used mostly during long cruise segments where the engine 100 is most stable.

In one embodiment, the ACC system 30 may comprise a transfer conduit 32 in fluid communication with core gas path 25 at a location, for example, of a compressor section 27 of engine 100. In some embodiments, the location can correspond to an axial location of a compressor boost stage of engine 100. In some embodiments, the location can correspond to an axial location of low-pressure compressor 16. In some embodiments, the location can correspond to an axial location downstream of low-pressure compressor 16. In some embodiments, the location can correspond to an axial location of high-pressure compressor 22. In some embodiments, the location can correspond to an axial location upstream of high-pressure compressor 22. In some embodiments, the location can correspond to an intermediate pressure location within the compressor section of engine 100 such as, for example, an axial location between low-pressure compressor 16 and high-pressure compressor 22. Accordingly, transfer conduit 32 may be configured to receive bleed air from the compressor section 27 of engine 100.

It is understood that transfer conduit 32 may be coupled to receive clearance control fluid (e.g., compressor bleed air) from one or more different sources depending on the temperature and flow requirements to achieve the desired tip clearance control. For example, in some embodiments, transfer conduit 32 may be configured to receive bypass air from bypass duct 28. In some embodiments, transfer duct 32 may be configured to receive a mixture of bypass air and pressurized bleed air extracted from compressor section 27 to produce clearance control fluid of a desired temperature and flow rate.

ACC system 30 may comprise one or more tip clearance control apparatus (referred hereinafter in the singular) including, in one embodiment, a flow regulator 34 in fluid communication with the turbine case 40 via one or more manifolds 36 (referred hereinafter in the singular). The flow regulator 34 is configured to control the flow of clearance control fluid (e.g., compressor bleed air) from transfer conduit 32 to the manifold 36, to in turn control the flow of clearance control fluid towards the turbine case 40 for controlling a radial displacement thereof. In one embodiment, the flow regulator 34 is a valve (also referred to herein as a "clearance control valve"). Flow regulator 34 may be actively controllable via controller 38 of engine 100, such as an electronic engine controller (EEC) for example. More specifically, the flow regulator 34 is configured to be actuated between at least one open position and at least one closed position in order to control the amount of clearance control fluid that is distributed to the turbine case 40 for adjusting the tip clearance. For example, when the flow regulator 34 is opened, the flow of clearance control fluid causes a decrease in the tip clearance. The reduction in (or closing of) the tip clearance may be desirable when the engine is decelerated (e.g., during landing approach), which results in a rapid increase in the tip clearance due to thermal and mechanical radial deflections of the engine components, particularly of the high-pressure turbine 24 components and case 40. Conversely, when the flow regulator 34 is closed, the flow of clearance control fluid causes an increase in the tip clearance. The increase in (or opening of) the tip clearance may be desirable in conditions, such as during takeoff, where the tip clearance is rapidly diminished as the speed of the engine 100 is increased.

It should be understood that the flow regulator 34 may be actuated via controller 38 to one or more positions. For example, the flow regulator 34 may be actuated to a fully closed position (i.e. a position in which no clearance control fluid passes through), one or more partially open positions so as to control or modulate the amount of clearance control fluid that passes through the flow regulator 34, and a fully open position (i.e. a position in which the maximum amount of clearance control fluid possible passes through the flow regulator 34).

In some embodiments, flow regulator 34 may be configured to controllably direct, via clearance control conduit 42, at least some of the clearance control fluid (delivered via transfer conduit 32) towards turbine case 40 (and manifold 36) of turbine section 23. In some embodiments, the flow regulator 34 may also controllably direct at least some of the clearance control fluid being delivered via transfer conduit 32 towards bypass duct 28. The amount of clearance control fluid directed towards turbine case 40 (and manifold 36) via clearance control conduit 42 is controlled by controller 38, by way of flow regulator 34, based on the requirements for tip clearance control. Manifold 36 may be of any suitable type and may be disposed in turbine section 23 of engine 100. The manifold 36 may be configured to receive at least some of the clearance control fluid (provided via clearance control conduit 42) and to direct the clearance control fluid on an outer surface of the turbine case 40 to cause the diameter of the turbine case 40 to shrink, thereby reducing (i.e. closing) the tip clearance.

Although illustrated as a turbofan engine, the engine 100 may alternatively be another type of engine, for example a turboshaft engine, also generally comprising in serial flow communication a compressor section, a combustor, and a turbine section, and a fan through which ambient air is propelled. A turboprop engine may also apply. In addition, although the engine 100 is described herein for flight applications, it should be understood that other uses, such as industrial or the like, may apply.

Figure 2:
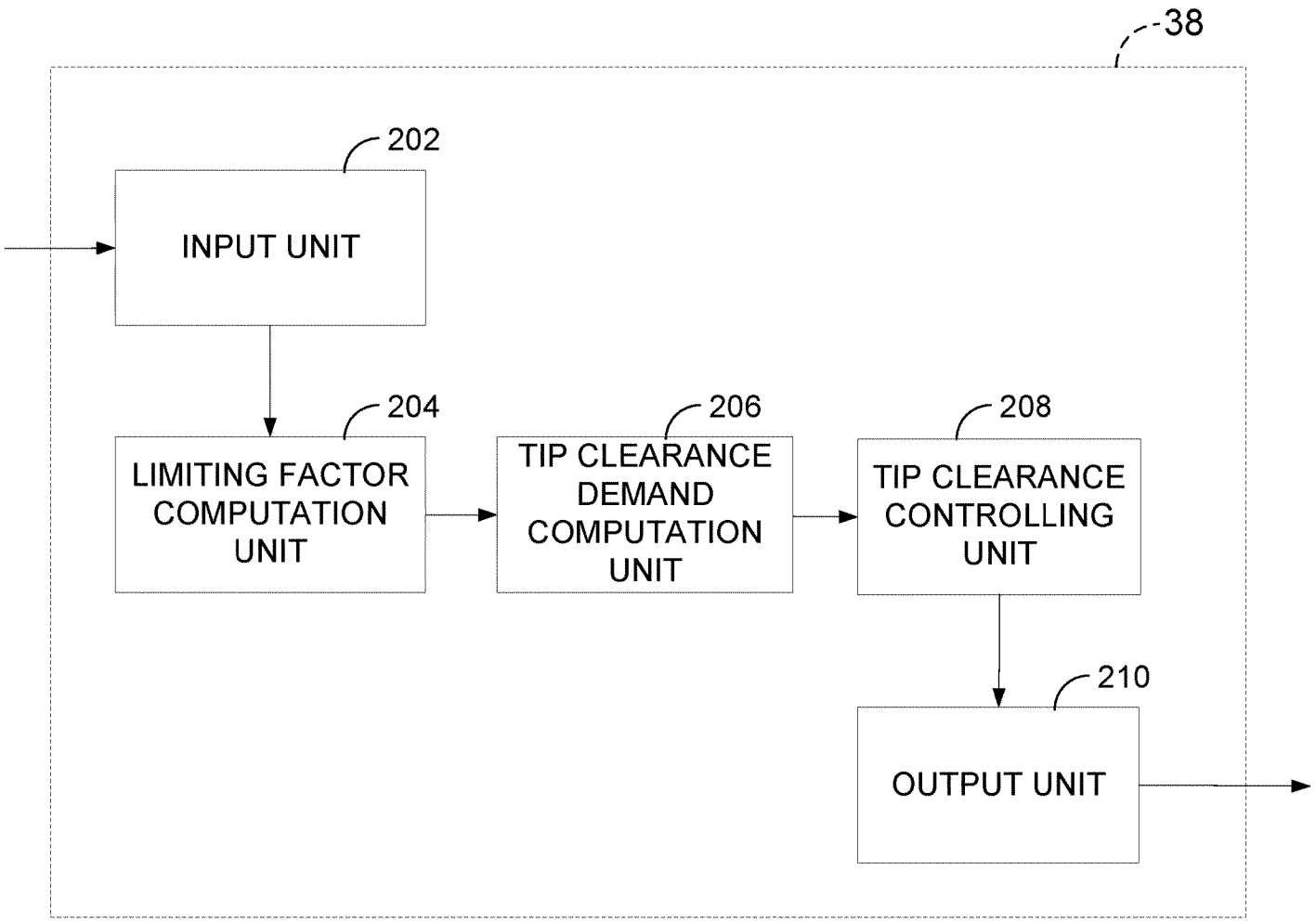
FIG. 2 is a block diagram of the controller of FIG. 1, in accordance with an illustrative embodiment.

Referring now to FIG. 2 in addition to FIG. 1, the controller 38 used to perform active clearance control (ACC) for an aircraft engine, such as gas turbine engine 100 of FIG. 1, will now be described in accordance with one embodiment. As will be described further below, the controller 38 may be configured to enable so-called "optimal" or "peak" operation of the ACC system 30 in regimes where such operation of the ACC system 30 at optimal operation may be detrimental to overall engine performance. As used herein, optimal operation of the ACC system 30 refers to operating the ACC system 30 according to an ACC control schedule that maximizes the operating efficiency of the high-pressure turbine 24 by closing tip clearances past a deviation (or distortion) of the turbine case 40 from a circular cross-section, also known as "out-of-roundness". In some embodiments, optimal operation of the ACC system 30 is achieved with the tip clearance control apparatus (e.g., the flow regulator 34) in a maximum open position. It should however be understood that optimal operation of the ACC system 30 may be achieved with the with the tip clearance control apparatus being brought to any other suitable position.

When the ACC system 30 is designed to maximize the operating efficiency of the high-pressure turbine 24, the increased core shaft speed (N2) of the engine 100 that results from the increased HPT efficiency may cause the operation of the high-pressure compressor 22 to deviate from its peak efficiency. This is due to the fact that the high-pressure compressor 22 and the high-pressure turbine 24 are operatively coupled to the same shaft (i.e. high-pressure spool 20). As a result, the overall performance of the engine 100 can worsen, with an increase in inter-turbine temperature (ITT) (i.e. an ITT degradation) being exhibited. To overcome this problem, it is proposed herein to apply a limit on the tip clearance value being targeted by the ACC control schedule (also referred to herein as the "ACC control schedule target" or the "target value of the tip clearance") in order to ensure that engine performance does not worsen as a result of application of the ACC control schedule target. This may in turn improve engine performance.

The controller 38 illustratively comprises an input unit 202, a limiting factor computation unit 204, a tip clearance demand computation unit 206, a tip clearance controlling unit 208, and an output unit 210. The input unit 202 is configured to obtain one or more measurements of one or more operational parameters of the engine 100. The operational parameter(s) being measured include, but are not limited to, one or more of ambient air pressure, ambient air temperature, engine velocity, an exhaust gas temperature, an engine inlet temperature, a compressor pressure, a compressor temperature, a shaft speed, and fuel consumption of the engine 100. In some embodiment, the input unit 202 may derive additional parameters from other measurements acquired throughout the engine, the additional parameters including, but not limited to, engine inlet pressure, turbine pressure, mass flow, and thrust. One or more sensing devices (not shown) positioned throughout the engine 100 may be used to acquire the measurement(s) of the operational parameter(s) and provide the measurement(s) to the controller 38 using any suitable communications means. The measurement(s) (and, in some embodiments, the additional parameters derived form the measurement(s)) are then received at the input unit 202 and used by the limiting factor computation unit 204 to determine, based on the operational parameter(s), a current value of the tip clearance and a target value of the tip clearance, and compute a limiting factor to be applied to the target value of the tip clearance in order to enable the ACC system 30 to maximize the efficiency of the high-pressure turbine 24 while maintaining or improving engine performance (i.e. while limiting the engine's core shaft speed to acceptable operating conditions).

As will be discussed further below, the limiting factor may be computed by the limiting factor computation unit 204 as a function of a corrected speed of the engine 100. It should however be understood that, in other embodiments, the limiting factor may be computed as a function of other suitable engine parameters. In one embodiment, these other parameters (referred to herein as operating parameters of the high-pressure compressor 22) may define operation of the high-pressure compressor 22 and may include, but are not limited to, the pressure in (or a pressure difference across) the engine's high-pressure compressor 22 and a corrected airflow entering the high-pressure compressor 22 (e.g., corrected by the engine's inlet temperature or pressure). For example, a pressure ratio between a pressure P3 taken at the exit of axial compressor and the entrance of the centrifugal compressor (i.e. at engine station 3, not shown) and a pressure P25 taken at engine station 2.5 (see FIG. 1) may be used. In yet other embodiments, the limiting factor may be computed based on other engine parameters indicative of a performance (or deterioration) of the engine 100, these other parameters including, but not being limited to, an ITT of the engine 100 and a fuel flow to the engine 100.

In one embodiment, in order to ensure a gradual transition in the ACC control schedule (from no application of the limiting factor to full application thereof), the limiting factor computation unit 204 is configured to compute a blending factor to be applied to the target value of the tip clearance. The blending factor may be computed as follows:

$$b_f = \begin{cases} 0, & \text{if Engine_Param} < X \\ \dfrac{\text{Engine_Param} - X}{(X+Y) - X} & \text{if } X \le \text{Engine_Param} \le X+Y \\ 1, & \text{if Engine_Param} > X+Y \end{cases} \quad (1)$$

where $b_f$ is the blending factor, Engine_Param is an engine parameter (e.g., corrected speed) which is related to operation of the high-pressure compressor 22 (i.e. an operating parameters of the high-pressure compressor 22) and/or is indicative of degradation of performance of the engine 100, X is a first engine parameter (e.g., corrected speed) threshold, and X+Y is a second engine parameter (e.g., corrected speed) threshold.

The values of the first and second engine parameter thresholds may vary depending on engine configuration. In one embodiment, the values of the first and second engine parameter thresholds are determined based on engine performance simulations across the entire flight envelope of the aircraft. The first engine parameter threshold represents a value of the engine parameter, which when reached, triggers application of the limiting factor to the target value of the tip clearance. In other words, the controller 38 does not apply the limiting factor (i.e. the blending factor is set to zero (0)) when the value of the parameter of the engine 100 is below the first engine parameter threshold. The second engine parameter threshold corresponds to the engine parameter value at which optimal operation of the ACC system 30 begins to degrade the engine's performance and the ITT improvement is negligible (e.g., substantially equal to zero (0)). When the value of the engine parameter is above the second engine parameter threshold, the blending factor is fully applied to the target value of the tip clearance (i.e. the blending factor is set to one (1)). When the value of the engine parameter is within the first and second engine parameter thresholds, the blending factor is set to a value between zero (0) and one (1), the value of the blending factor being calculated linearly as a function of the engine parameter.

As previously noted, the limiting factor, and more specifically the blending factor, may be computed as a function of a corrected speed (Ncorr) of the engine 100 as follows:

$$b_f = \begin{cases} 0, & \text{if } Ncorr < X\ rpm \\ \dfrac{Ncorr - X}{(X+Y) - X} & \text{if } X\ rpm \le Ncorr \le X+Y\ rpm \\ 1, & \text{if } Ncorr > X+Y\ rpm \end{cases} \quad (2)$$

where Ncorr is the engine's corrected speed, X is a first corrected speed threshold, and X+Y is a second corrected speed threshold.

It should however be understood that, in other embodiments, the blending factor may be based on the pressure ratio across the high-pressure compressor 22, a corrected airflow entering the high-pressure compressor 22, an ITT of the engine 100, or a fuel flow to the engine 100.

The pressure ratio across the high-pressure compressor 22 may be computed as follows:

$$PR = P3Q25 = \frac{P3}{P2.5} \quad (3)$$

where PR is the pressure ratio, P3 is the total pressure at the exit of the high-pressure compressor 22 (typically at engine station 3), and P2.5 is the total pressure at the entrance of the high-pressure compressor 22 (typically at engine station 2.5).

The corrected airflow entering the high-pressure compressor 22 may be computed as follows:

$$Wcorr = \frac{W2.5\sqrt{\frac{T2.5}{T_{STD}}}}{\frac{P2.5}{P_{STD}}} \tag{4}$$

where Wcorr is the corrected airflow, W2.5 is the mass flow rate of fluid entering the high-pressure compressor 22, T2.5 and P2.5 are the total temperature and total pressure at the entrance of the high-pressure compressor 22, respectively, and $T_{STD}$ & $P_{STD}$ are the standard (sea level static) ambient temperature and pressure, respectively.

In addition, although the blending factor is described herein above as being computed linearly, it should be understood that the limiting factor computation unit 204 may be configured to compute the blending factor using any suitable approach other than a linear approach. For example, additional thresholds (other than X and X+Y described above) may be defined and curve fitting using functions including, but not limited to, higher order polynomial functions using linear regression, may then be used to obtain the blending factor. Alternatively, each threshold may be connected using a piecemeal linear function in order to compute the blending factor.

In one embodiment, the corrected speed is a corrected shaft speed of the engine 100. More specifically, the engine's core shaft speed is corrected to the total temperature of the air entering the low-pressure compressor 16 at a leading edge of the fan 14, also referred to herein as the engine's inlet temperature taken at engine station 2 (see FIG. 1). The limiting factor computation unit 204 may therefore compute the corrected speed as follows:

$$Ncorr = N2R2 = \frac{N2}{\sqrt{\frac{T2}{T_{STD}}}} \tag{5}$$

where N2R2 is the corrected shaft speed, N2 is the engine's core shaft speed (i.e. the core shaft speed of the high-pressure compressor 22 and the high-pressure turbine 24), T2 is the engine's inlet total temperature taken at engine station 2 measured in Rankine, and $T_{STD}$ is a standard (i.e. sea level static) air temperature. In one embodiment, the standard air temperature is 518.67 Rankine. As used herein, the term "total temperature" (e.g., of a moving fluid) refers to the temperature that would be measured if the moving fluid flow were brought to rest without any losses, as opposed to "static temperature" which refers to the temperature as if measured with the moving fluid flow.

In another embodiment, the corrected speed is a corrected shaft speed of the engine 100, where the engine's core shaft speed is corrected to the total temperature of the air entering the high-pressure compressor 22, also referred to herein as the engine's inlet temperature taken at engine station 2.5. The limiting factor computation unit 204 may therefore compute the corrected speed as follows:

$$Ncorr = N2R25 = \frac{N2}{\sqrt{\frac{T25}{T_{STD}}}} \tag{6}$$

where N2R25 is the corrected shaft speed and T25 is the inlet temperature of the high-pressure compressor 22 taken at engine station 2.5.

In yet another embodiment, the corrected speed is a corrected fan speed of the engine 100, where the engine's fan speed is corrected to the engine's inlet temperature (taken at engine station 2). The limiting factor computation unit 204 may therefore compute the corrected speed as follows:

$$Ncorr = N1R2 = \frac{N1}{\sqrt{\frac{T2}{T_{STD}}}} \tag{7}$$

where N1R2 is the corrected fan speed and Ni is the engine's fan speed.

Once the blending factor is computed, the tip clearance demand computation unit 206 is then configured to apply the limiting factor (computed by the limiting factor computation unit 204) to the target value of the tip clearance in order to obtain a tip clearance demand that is output by the controller 38 and used to control the tip clearance control apparatus (e.g., to control the clearance control valve 34). This can be achieved by computing the tip clearance demand as follows:

$$ACC_{dmd=}(1-b_f)*ACC_{schedule}+b_f*(ACC_{schedule}+ACC_{offset}) \tag{8}$$

where $ACC_{dmd}$ is the tip clearance demand, $ACC_{schedule}$ is the target value of the tip clearance (which may be a function of altitude, N2, etc.), and $ACC_{offset}$ is an offset value that is applied in the ACC control schedule to ensure that the ACC system 30 does not cause a degradation in the engine's performance. For example, implementation of the offset as per equation (8) may involve shutting down the ACC system 30 or operating the engine 100 at partial power. The offset value may be predetermined and retrieved from a memory or other suitable storage accessible to the controller 38. The offset value may alternatively be computed by the controller 38 as a function of parameters of the engine 100 (e.g., based on the measurement(s) of the engine's operational parameters).

The tip clearance controlling unit 208 is then configured to control the tip clearance control apparatus based on a difference between the current value of the tip clearance and the tip clearance demand (computed by the tip clearance demand computation unit 206). For this purpose, the tip clearance controlling unit 208 is configured to compare the current value of the tip clearance to the tip clearance demand. When the tip clearance controlling unit 208 determines that the current value of the tip clearance is above the tip clearance demand, the tip clearance controlling unit 208 generates at least one control signal comprising one or more instructions to cause the flow regulator or clearance control valve 34 to open for lowering (i.e. closing) the tip clearance. When the tip clearance controlling unit 208 determines that the current value of the tip clearance is below the tip clearance demand, the tip clearance controlling unit 208 generates at least one control signal to cause the clearance control valve 34 to close for increasing (i.e. opening) the tip clearance. The at least one control signal generated by the tip clearance controlling unit 208 is then sent to the output unit 210 for transmission (using any suitable communication means) to the clearance control valve 34.

Figure 3:
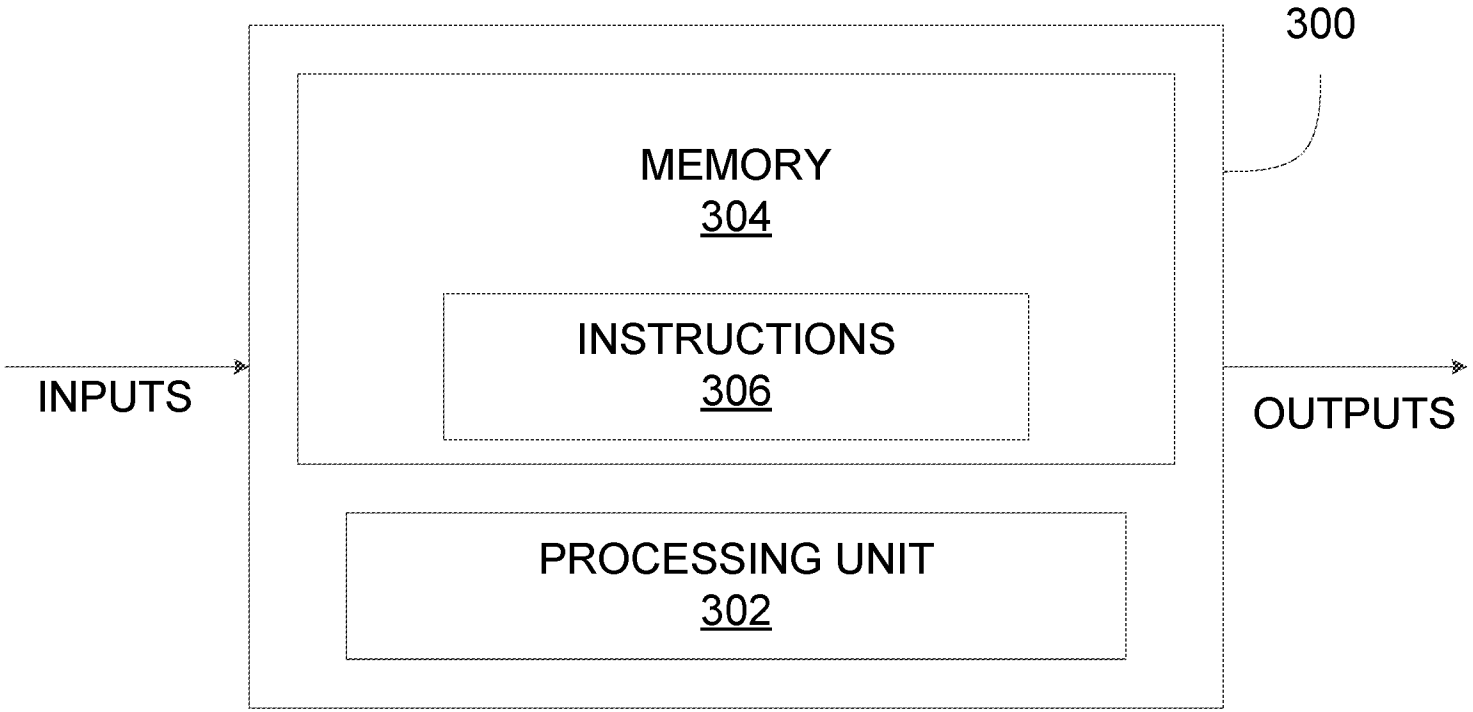
FIG. 3 is a block diagram of an example computing device, in accordance with an illustrative embodiment.

With reference to FIG. 3, an example of a computing device 300 is illustrated. For simplicity only one computing device 300 is shown but the system may include more computing devices 300 operable to exchange data. The computing devices 300 may be the same or different types of devices. The controller (reference 38 in FIG. 1 and FIG. 2) may be implemented with one or more computing devices 300. Note that the controller 38 can be implemented as part of a full-authority digital engine controls (FADEC) or other similar device, including EEC, engine control unit (ECU), electronic propeller control, propeller control unit, and the like. In some embodiments, the controller 38 is implemented as a Flight Data Acquisition Storage and Transmission system, such as a FAST™ system. The controller 38 may be implemented in part in the FAST™ system and in part in the EEC. Other embodiments may also apply.

The computing device 300 comprises a processing unit 302 and a memory 304 which has stored therein computer-executable instructions 306. The processing unit 302 may comprise any suitable devices configured to implement the method 400 described herein below with reference to FIG. 4 such that instructions 306, when executed by the computing device 300 or other programmable apparatus, may cause the functions/acts/steps performed as part of the method 400 as described herein to be executed. The processing unit 302 may comprise, for example, any type of general-purpose microprocessor or microcontroller, a digital signal processing (DSP) processor, a central processing unit (CPU), an integrated circuit, a field programmable gate array (FPGA), a reconfigurable processor, other suitably programmed or programmable logic circuits, or any combination thereof.

The memory 304 may comprise any suitable known or other machine-readable storage medium. The memory 304 may comprise non-transitory computer readable storage medium, for example, but not limited to, an electronic, magnetic, optical, electromagnetic, infrared, or semiconductor system, apparatus, or device, or any suitable combination of the foregoing. The memory 304 may include a suitable combination of any type of computer memory that is located either internally or externally to device, for example random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like. Memory 304 may comprise any storage means (e.g., devices) suitable for retrievably storing machine-readable instructions 306 executable by processing unit 302.

The methods and systems for active clearance control described herein may be implemented in a high level procedural or object oriented programming or scripting language, or a combination thereof, to communicate with or assist in the operation of a computer system, for example the computing device 300. Alternatively, the methods and systems for active clearance control may be implemented in assembly or machine language. The language may be a compiled or interpreted language. Program code for implementing the methods and systems for active clearance control may be stored on a storage media or a device, for example a ROM, a magnetic disk, an optical disc, a flash drive, or any other suitable storage media or device. The program code may be readable by a general or special-purpose programmable computer for configuring and operating the computer when the storage media or device is read by the computer to perform the procedures described herein. Embodiments of the methods and systems for active clearance control may also be considered to be implemented by way of a non-transitory computer-readable storage medium having a computer program stored thereon. The computer program may comprise computer-readable instructions which cause a computer, or more specifically the processing unit 302 of the computing device 300, to operate in a specific and predefined manner to perform the functions described herein, for example those described in the method 400.

Computer-executable instructions may be in many forms, including program modules, executed by one or more computers or other devices. Generally, program modules include routines, programs, objects, components, data structures, etc., that perform particular tasks or implement particular abstract data types. Typically the functionality of the program modules may be combined or distributed as desired in various embodiments.

Figure 4A:
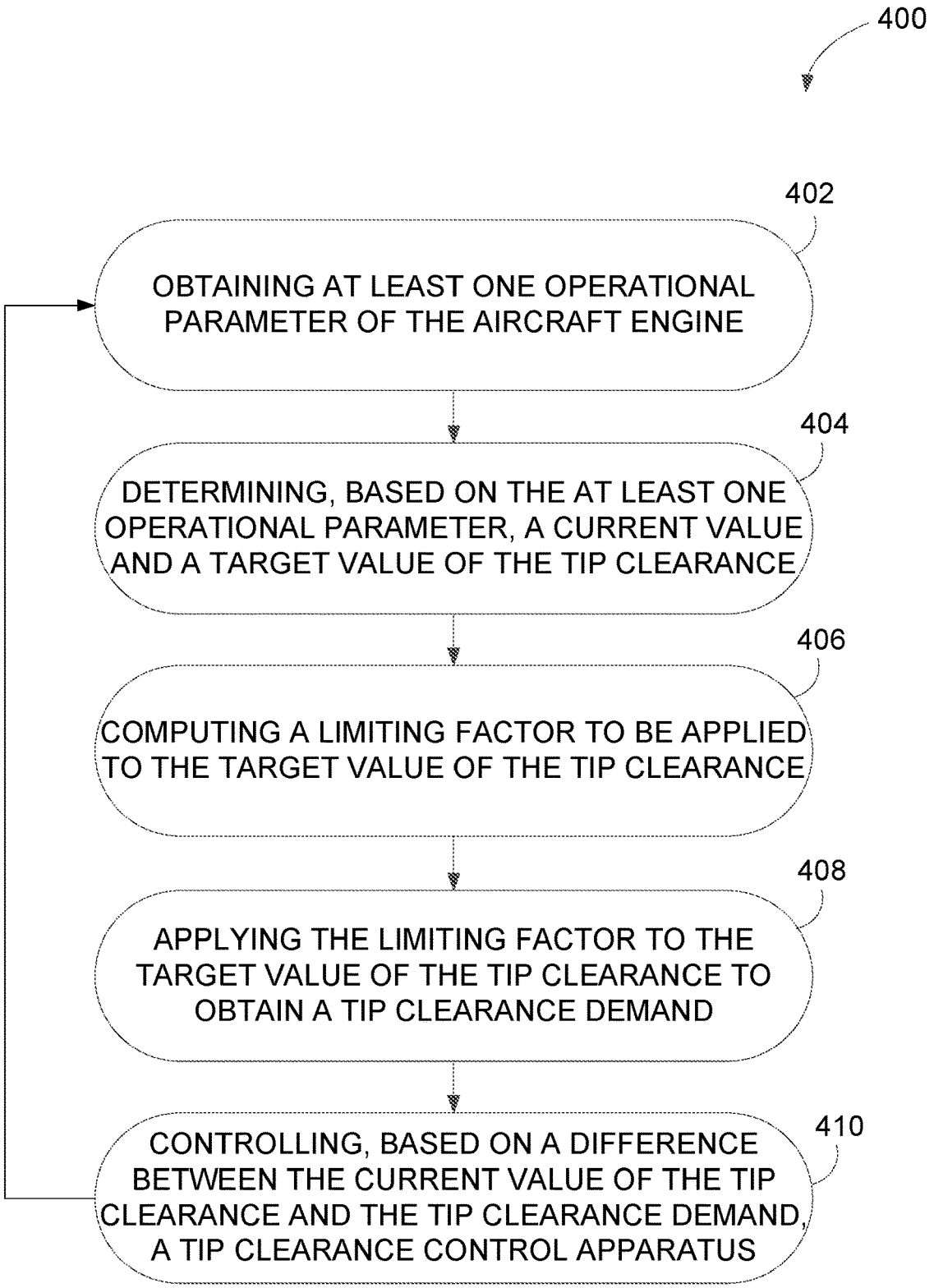
FIG. 4A is a flow diagram of an active clearance control method for an aircraft engine, in accordance with an illustrative embodiment.
Figure 4B:
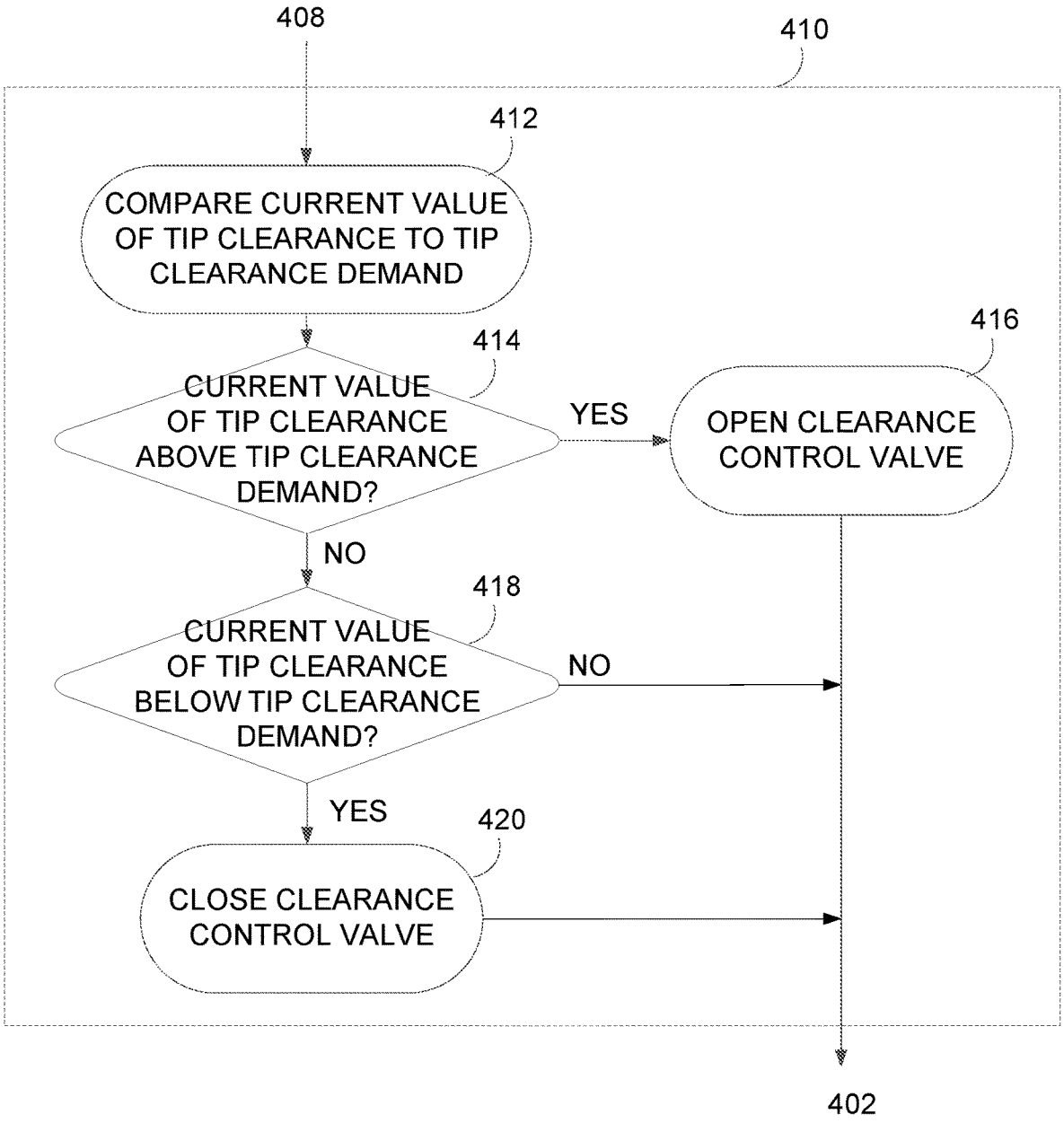
FIG. 4B is a flow diagram of the step of FIG. 4A of controlling a tip clearance control apparatus, in accordance with an illustrative embodiment.

Referring now to FIG. 4A and FIG. 4B, an active clearance control method 400 for an aircraft engine, such as gas turbine engine 100 of FIG. 1, will now be described in accordance with one embodiment. The method 400 comprises obtaining, at step 402, at least one operational parameter of the aircraft engine. As described herein above with reference to FIG. 2, step 402 illustratively comprises obtaining operating engine parameter(s) acquired using one or more sensing devices associated with the aircraft engine. The next step 404 involves determining, based on the operational parameter(s), a current value of the tip clearance and a target value of the tip clearance. The next step 406 involves computing a limiting factor to be applied to the target value of the tip clearance in order to enable optimal operation of the ACC control system (reference 30 in FIG. 1) and maximize HPT efficiency while improving engine performance, as discussed herein above. Step 408 then involves applying the limiting factor to the target value of the tip clearance to obtain a tip clearance demand. In one embodiment, steps 406 and 408 involve computing one or more of equations (1) to (8) described herein above. The method 400 then flows to step 410 which involves controlling a tip clearance control apparatus (e.g., clearance control valve described herein above with reference to FIG. 1), based on a difference between the current value of the tip clearance and the tip clearance demand.

As illustrated in FIG. 4B, step 410 illustratively comprises comparing, at step 412, the current value of the tip clearance (determined at step 404) to the tip clearance demand (obtained at step 408). The next step 414 is to assess whether the current value of the tip clearance is above the tip clearance demand. If this is the case, the clearance control valve is opened at step 416 to lower the tip clearance. Otherwise, when it is determined that the current value of the tip clearance is not above the tip clearance demand, the next step 418 is to assess whether the current value of the tip clearance is below the tip clearance demand. If this is the case, the clearance control valve is closed at step 420 to increase the tip clearance. Otherwise, if it is determined that the current value of the tip clearance is neither above nor below the tip clearance demand (meaning that the current value of the tip clearance is substantially equal to the tip clearance demand), the method 400 flows back to step 402 of obtaining at least one operational parameter of the aircraft engine. In order to open or close the clearance control valve, one or more control signals may be generated (at step 416 or 420) and output to the clearance control valve to cause the clearance control valve to be actuated to the open or closed position, as discussed herein above. Once the clearance control valve is opened or closed, the method 400 flows back to step 402 of obtaining at least one operational parameter of the aircraft engine.

The embodiments described herein are implemented by physical computer hardware, including computing devices, servers, receivers, transmitters, processors, memory, displays, and networks. The embodiments described herein provide useful physical machines and particularly configured computer hardware arrangements. The embodiments described herein are directed to electronic machines and methods implemented by electronic machines adapted for processing and transforming electromagnetic signals which represent various types of information. The embodiments described herein pervasively and integrally relate to machines, and their uses; and the embodiments described herein have no meaning or practical applicability outside their use with computer hardware, machines, and various hardware components. Substituting the physical hardware particularly configured to implement various acts for non-physical hardware, using mental steps for example, may substantially affect the way the embodiments work. Such computer hardware limitations are clearly essential elements of the embodiments described herein, and they cannot be omitted or substituted for mental means without having a material effect on the operation and structure of the embodiments described herein. The computer hardware is essential to implement the various embodiments described herein and is not merely used to perform steps expeditiously and in an efficient manner.

The term "connected" or "coupled to" may include both direct coupling (in which two elements that are coupled to each other contact each other) and indirect coupling (in which at least one additional element is located between the two elements).

The technical solution of embodiments may be in the form of a software product. The software product may be stored in a non-volatile or non-transitory storage medium, which can be a compact disk read-only memory (CD-ROM), a USB flash disk, or a removable hard disk. The software product includes a number of instructions that enable a computer device (personal computer, server, or network device) to execute the methods provided by the embodiments.

The embodiments described in this document provide non-limiting examples of possible implementations of the present technology. Upon review of the present disclosure, a person of ordinary skill in the art will recognize that changes may be made to the embodiments described herein without departing from the scope of the present technology. Yet further modifications could be implemented by a person of ordinary skill in the art in view of the present disclosure, which modifications would be within the scope of the present technology.

The invention claimed is:

1. A method for controlling a tip clearance between a turbine casing and turbine blade tips of an aircraft engine, the method comprising:

obtaining at least one operational parameter of the aircraft engine;

determining, based on the at least one operational parameter, a current value of the tip clearance and a target value of the tip clearance;

computing a limiting factor to be applied to the target value of the tip clearance, the computing the limiting factor comprises computing a blending factor as a function of a parameter of the aircraft engine related to an operation of a high-pressure compressor of the aircraft engine and/or indicative of degradation of a performance of the aircraft engine, the blending factor computed as:

$$b_f = \begin{cases} 0, & \text{if Engine_Param} < X \\ \dfrac{\text{Engine_Param} - X}{(X+Y) - X}, & \text{if } X \le \text{Engine_Param} \le X+Y \\ 1, & \text{if Engine_Param} > X+Y \end{cases}$$

where bf is the blending factor, Engine_Param is the parameter of the aircraft engine, X is a first engine parameter threshold, and X+Y is a second engine parameter threshold;

applying the limiting factor to the target value of the tip clearance to obtain a tip clearance demand for the aircraft engine; and controlling a tip clearance control apparatus of the aircraft engine based on a difference between the current value of the tip clearance and the tip clearance demand.

2. The method of claim 1, wherein the controlling the tip clearance control apparatus comprises controlling a clearance control valve in flow communication with the turbine casing, the clearance control valve configured to control a flow of clearance control fluid towards the turbine casing for controlling a radial displacement of the turbine casing.

3. The method of claim 2, wherein the controlling the tip clearance control apparatus comprises:

comparing the current value of the tip clearance to the tip clearance demand;

when the current value of the tip clearance is above the tip clearance demand, causing the clearance control valve to open for decreasing the tip clearance; and when the current value of the tip clearance is below the tip clearance demand, causing the clearance control valve to close for increasing the tip clearance.

4. The method of claim 1, wherein the applying the limiting factor to the target value of the tip clearance to obtain the tip clearance demand for the aircraft engine comprises computing:

$$ACC_{dmd}=(1-b_f)*ACC_{schedule}+b_f*(ACC_{schedule}+ACC_{offset})$$

where $ACC_{dmd}$ is the tip clearance demand, $ACC_{schedule}$ is the target value of the tip clearance, and $ACC_{offset}$ is an offset value preventing a degradation in performance of the aircraft engine.

5. The method of claim 1, wherein the parameter of the aircraft engine is one of a corrected speed of the aircraft engine, a pressure ratio across the high-pressure compressor of the aircraft engine, a corrected airflow entering the high-pressure compressor, an inter-turbine temperature of the aircraft engine, and a fuel flow to the aircraft engine.

6. The method of claim 5, wherein the corrected speed of the aircraft engine is a corrected shaft speed computed as:

$$Ncorr = N2R2 = \frac{N2}{\sqrt{\dfrac{T2}{T_{STD}}}}$$

where Ncorr is the corrected speed of the aircraft engine, N2R2 is the corrected shaft speed of the aircraft engine, N2 is a core shaft speed of the aircraft engine, T2 is a temperature of air entering a low-pressure compressor of the aircraft engine, and $T_{STD}$ is a standard air temperature.

7. The method of claim 5, wherein the corrected speed of the aircraft engine is a corrected shaft speed computed as:

$$Ncorr = N2R25 = \frac{N2}{\sqrt{\frac{T25}{T_{STD}}}}$$

where Ncorr is the corrected speed of the aircraft engine, N2R25 is the corrected shaft speed of the aircraft engine, N2 is a core shaft speed of the aircraft engine, T25 is a temperature of air entering a high-pressure compressor of the aircraft engine, and $T_{STD}$ is a standard air temperature.

8. The method of claim 5, wherein the corrected speed of the aircraft engine is a corrected fan speed computed as:

$$Ncorr = N1R2 = \frac{N1}{\sqrt{\frac{T2}{T_{STD}}}}$$

where Ncorr is the corrected speed of the aircraft engine, N1R2 is the corrected fan speed of the aircraft engine, N1 is a core fan speed of the aircraft engine, T2 is a temperature of air entering a low-pressure compressor of the aircraft engine, and $T_{STD}$ is a standard air temperature.

9. The method of claim 1, wherein the at least one operating parameter of the aircraft engine comprises one or more of an ambient air pressure, an ambient air temperature, an engine velocity, an exhaust gas temperature, an engine inlet pressure, an engine inlet temperature, a compressor pressure, a compressor temperature, a turbine pressure, a shaft speed, a mass flow, a thrust, and a fuel consumption of the aircraft engine.

10. A system for controlling a tip clearance between a turbine casing and turbine blade tips of an aircraft engine, the system comprising:

a processing unit; and a non-transitory computer readable medium having stored thereon program code executable by the processing unit for:

obtaining at least one operational parameter of the aircraft engine;

determining, based on the at least one operational parameter, a current value of the tip clearance and a target value of the tip clearance;

computing a limiting factor to be applied to the target value of the tip clearance, the computing the limiting factor comprising computing a blending factor as a function of a parameter of the aircraft engine related to an operation of a high-pressure compressor of the aircraft engine and/or indicative of degradation of a performance of the aircraft engine, the blending factor computed as:

$$b_f = \begin{cases} 0, & \text{if Engine_Param} < X \\ \frac{\text{Engine_Param} - X}{(X+Y) - X}, & \text{if } X \le \text{Engine_Param} \le X+Y \\ 1, & \text{if Engine_Param} > X+Y \end{cases}$$

where $b_t$ is the blending factor, Engine Param is the parameter of the aircraft engine, Xis a first engine parameter threshold, and X+Y is a second engine parameter threshold;

applying the limiting factor to the target value of the tip clearance to obtain a tip clearance demand for the aircraft engine; and controlling a tip clearance control apparatus of the aircraft engine based on a difference between the current value of the tip clearance and the tip clearance demand.

11. The system of claim 10, wherein the program code is executable by the processing unit for controlling the tip clearance control apparatus comprising controlling a clearance control valve in flow communication with the turbine casing, the clearance control valve configured to control a flow of clearance control fluid towards the turbine casing for controlling a radial displacement of the turbine casing.

12. The system of claim 11, wherein the program code is executable by the processing unit for controlling the tip clearance control apparatus comprising:

comparing the current value of the tip clearance to the tip clearance demand;

when the current value of the tip clearance is above the tip clearance demand, causing the clearance control valve to open for decreasing the tip clearance; and when the current value of the tip clearance is below the tip clearance demand, causing the clearance control valve to close for increasing the tip clearance.

13. The system of claim 10, wherein the program code is executable by the processing unit for applying the limiting factor to the target value of the tip clearance to obtain the tip clearance demand for the aircraft engine comprising computing:

$$ACC_{dmd=(}1-b_f)*ACC_{schedule}+b_f*(ACC_{schedule}+ACC_{offset})$$

where $ACC_{dmd}$ is the tip clearance demand, $ACC_{schedule}$ is the target value of the tip clearance, and $ACC_{offset}$ is an offset value preventing a degradation in performance of the aircraft engine.

14. The system of claim 10, wherein the parameter of the aircraft engine is one of a corrected speed of the aircraft engine, a pressure ratio across the high-pressure compressor of the aircraft engine, a corrected airflow entering the high-pressure compressor, an inter-turbine temperature of the aircraft engine, and a fuel flow to the aircraft engine.

15. The system of claim 14, wherein the program code is executable by the processing unit for computing the corrected speed of the aircraft engine as:

$$Ncorr = N2R2 = \frac{N2}{\sqrt{\frac{T2}{T_{STD}}}}$$

where Ncorr is the corrected speed of the aircraft engine, N2R2 is the corrected shaft speed of the aircraft engine, N2 is a core shaft speed of the aircraft engine, T2 is a temperature of air entering a low-pressure compressor of the aircraft engine, and $T_{STD}$ is a standard air temperature.

16. The system of claim 14, wherein the program code is executable by the processing unit for computing the corrected speed of the aircraft engine as:

$$Ncorr = N2R25 = \frac{N2}{\sqrt{\frac{T25}{T_{STD}}}}$$

where Ncorr is the corrected speed of the aircraft engine, N2R25 is the corrected shaft speed of the aircraft engine, N2 is a core shaft speed of the aircraft engine, T25 is a temperature of air entering a high-pressure compressor of the aircraft engine, and $T_{STD}$ is a standard air temperature.

17. The system of claim 14, wherein the program code is executable by the processing unit for computing the corrected speed of the aircraft engine as:

$$Ncorr = N1R2 = \frac{N1}{\sqrt{\frac{T2}{T_{STD}}}}$$

where Ncorr is the corrected speed of the aircraft engine, N1R2 is the corrected fan speed of the aircraft engine, N1 is a core fan speed of the aircraft engine, T2 is a temperature of air entering a low-pressure compressor of the aircraft engine, and $T_{STD}$ is a standard air temperature.

18. The system of claim 10, wherein the at least one operating parameter of the aircraft engine comprises one or more of an ambient air pressure, an ambient air temperature, an engine velocity, an exhaust gas temperature, an engine inlet pressure, an engine inlet temperature, a compressor pressure, a compressor temperature, a turbine pressure, a shaft speed, a mass flow, a thrust, and a fuel consumption of the aircraft engine.

* * * * *